US006615898B2

(12) United States Patent
Schulte

(10) Patent No.: US 6,615,898 B2
(45) Date of Patent: Sep. 9, 2003

(54) RELEASE MECHANISM FOR A SECTIONAL DOOR

(75) Inventor: Peter S. Schulte, East Dubuque, IL (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/870,435

(22) Filed: May 30, 2001

(65) Prior Publication Data

US 2002/0179254 A1 Dec. 5, 2002

(51) Int. Cl.[7] ..... E05D 15/16
(52) U.S. Cl. ..... 160/201
(58) Field of Search ..... 160/201, 207, 160/205, 271, 273.1; 16/91, 103, 106, DIG. 1

(56) References Cited

U.S. PATENT DOCUMENTS

| | | | | | |
|---|---|---|---|---|---|
| 3,336,968 | A | * | 8/1967 | Curtis | 160/201 X |
| 3,484,812 | A | | 12/1969 | Holland | 160/201 |
| 4,676,293 | A | | 6/1987 | Hanssen | 160/201 |
| 5,025,847 | A | | 6/1991 | Mueller | 160/270 |
| 5,056,579 | A | | 10/1991 | Krafutler | 160/271 |
| 5,139,074 | A | | 8/1992 | Warner | 160/271 |
| 5,141,044 | A | | 8/1992 | Hying et al. | 160/271 |
| 5,219,015 | A | | 6/1993 | Kraeutler | 160/271 |
| 5,271,448 | A | * | 12/1993 | Delgado | 160/271 X |
| 5,353,859 | A | | 10/1994 | Oltahfer et al. | 160/310 |
| 5,392,836 | A | | 2/1995 | West et al. | 160/273.1 |
| 5,535,805 | A | | 7/1996 | Kellogg et al. | 160/201 |
| 5,584,333 | A | | 12/1996 | Torchetti et al. | 160/201 |
| 5,601,133 | A | | 2/1997 | Krupke et al. | 160/265 |
| 5,638,883 | A | | 6/1997 | Schulte | 160/271 |
| 5,655,591 | A | | 8/1997 | Knutson | 160/265 |
| 5,720,332 | A | | 2/1998 | Nachreiner | 160/205 |
| 5,727,614 | A | * | 3/1998 | Lichy | 160/201 |
| 5,743,317 | A | | 4/1998 | Beringer et al. | 160/10 |
| 5,765,622 | A | * | 6/1998 | Lichy | 160/201 X |
| 5,829,504 | A | | 11/1998 | Ekstrand et al. | 160/201 |
| 5,865,235 | A | | 2/1999 | Krupke et al. | 160/191 |
| 5,887,385 | A | | 3/1999 | Horner et al. | 49/26 |
| 5,893,403 | A | | 4/1999 | Megens | 160/35 |
| 5,915,448 | A | * | 6/1999 | Schulte | 160/271 |
| 5,918,660 | A | * | 7/1999 | Crawford et al. | 160/201 |
| 5,927,368 | A | | 7/1999 | Rohrer et al. | 160/201 |
| 5,944,086 | A | | 8/1999 | Gruben et al. | 160/266 |
| 5,957,187 | A | | 9/1999 | Gruben et al. | 160/267.1 |
| 6,019,156 | A | | 2/2000 | Wagner et al. | 160/310 |
| 6,041,844 | A | | 3/2000 | Kellogg et al. | 160/201 |
| 6,053,237 | A | | 4/2000 | Bertilsson et al. | 160/205 |
| 6,089,305 | A | | 7/2000 | Gruben et al. | 160/271 |
| 6,095,229 | A | * | 8/2000 | Kellogg et al. | 160/201 |
| 6,119,307 | A | | 9/2000 | Weishar et al. | 16/87 R |
| 6,123,139 | A | | 9/2000 | Kalempa et al. | 160/188 |
| 6,148,897 | A | * | 11/2000 | Horner et al. | 160/271 |
| 6,315,027 | B1 | * | 11/2001 | Lichy | 160/205 |

FOREIGN PATENT DOCUMENTS

DE 295 01 048.7 3/1995

OTHER PUBLICATIONS

International Search Report from PCT/US02/17132.

* cited by examiner

*Primary Examiner*—David M. Purol
(74) *Attorney, Agent, or Firm*—Marshall, Gerstein & Borun

(57) ABSTRACT

A release mechanism for protecting a sectional door under impact allows one or more door panels to breakaway from its guide track without damaging the door. The release mechanism includes a snap-in pin that can be selectively repositioned to provide various operating modes. Examples of operating modes include unidirectional release, bi-directional release, and a disabled mode. In some cases, the breakaway threshold is greater in one direction than another. In the disabled mode, the release mechanism is not meant to release. Some embodiments include a door locking mechanism that still allows the release mechanism to operate.

8 Claims, 8 Drawing Sheets

FIG. 2
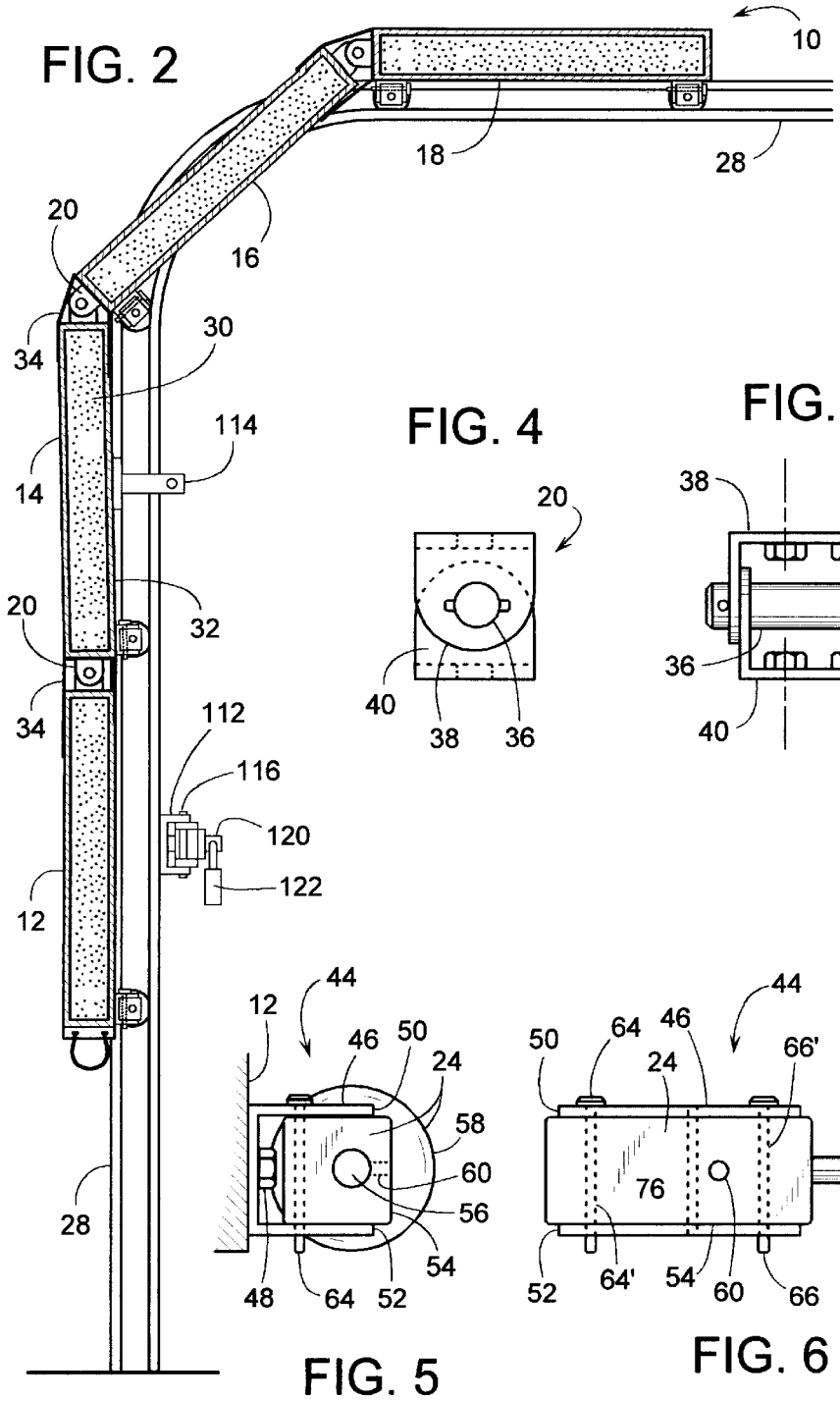
FIG. 4
FIG. 3
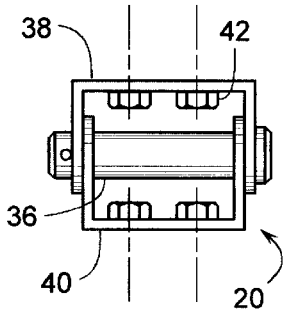
FIG. 5
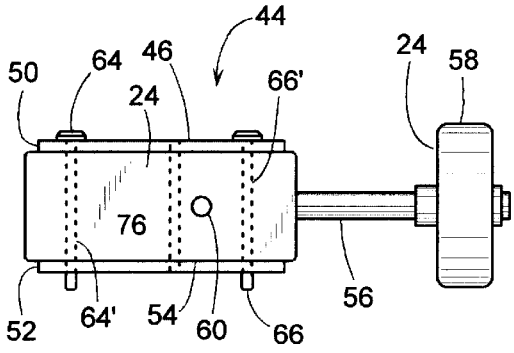
FIG. 6

RELEASE MECHANISM FOR A SECTIONAL DOOR

BACKGROUND OF THE INVENTION

1. Field of the Invention

The subject invention generally pertains to sectional doors and more specifically to a release mechanism for such a door.

2. Description of Related Art

A sectional door typically includes a series of panels whose adjacent horizontal edges are each pivotally connected by a row of hinges. As the door opens or closes, the door panels travel along two lateral tracks that in one configuration curve between horizontal and vertical. To close the door, the tracks guide the panels to a vertical position. When the door opens, the hinges allow the panels to curve around onto horizontal sections of the tracks, where the door panels store horizontally overhead. In other configurations, the sectional door maintains a generally vertical, planar configuration and is stored more directly above the doorway. Such doors, regardless of their configuration, can be powered up or down or can be manually operated. To ease the operation of the door, a torsion spring is often used to offset the weight of the door panels. Sectional doors are commonly used as residential garage doors; however, they are also often used in warehouses and other industrial buildings.

When used in high-traffic industrial applications, sectional doors are very susceptible to being struck by large trucks, trailers, forklifts and other vehicles passing through the doorway. There are different reasons why vehicles collide with doors. One of the more common causes is a door's torsion spring becoming weak with age or not being properly preloaded. This can allow a door to droop down into the doorway from a fully open position or not open fully at all. In such cases, an upper edge of a vehicle traveling through the doorway may strike the lower portion of the drooping door, which can damage one or more door panels, as well as damage door-mounting hardware, such as hinges, rollers and track.

Doors are also often installed adjacent to a dock leveler of a loading dock. When the door is closed, such doors can be damaged as material handling equipment stage loads on the dock leveler. For instance, a forklift may accidentally push a load up against the door.

Consequently, some doors are provided with some type of breakaway feature that allows a door to give way to a collision without being damaged. For example, a sectional door described in U.S. Pat. No. 5,727,614 includes a track-following roller that can break away from its mounting bracket in reaction to a collision. After the collision, the roller can be reattached to the bracket. The breakaway device, however, has its limitations. Upon breaking away, the roller can completely separate from the mounting bracket, thus an impact could throw the roller where it may be difficult to find. This is particularly true for a loading dock door that is installed adjacent to a dock leveler. In such cases, the roller may fall into a pit that is underneath a conventional dock leveler or fall into some snow that may be just outside the building. It also appears that the '614 device breaks away at a predetermined force, which cannot be readily adjusted or altered once the door is installed. Depending on the application, it may be desirable to have a door that breaks away in one direction easier than another. For instance, for heavier doors, it may be desirable to have a higher breakaway force in one direction (from outside to inside), so that the door does not break away under its own weight when fully open and stored overhead. It some cases, for example, it may be beneficial to have a door whose breakaway feature only acts in one direction. In windy areas, it may be better to have a door that only breaks away in an outward direction to avoid the door giving way to strong winds.

Another breakaway device, shown in U.S. Pat. No. 6,039,106 does include a means for adjusting the breakaway force. The breakaway force is adjusted by turning a setscrew, which adjusts the pressure that a spring-loaded plunger exerts against a detent of a track-following guide member. Under sufficient breakaway force, the guide member is able to swing its detent out from underneath the force of the plunger; however, the guide member does not completely separate from the plunger. The swinging motion also releases the guide member out from within the track, which releases the door to avoid damage. Although the device has an adjustable breakaway, it appears that the breakaway force is the same in both directions and that the device cannot be readily locked to disable the breakaway feature.

Other examples of breakaway mechanisms are shown in U.S. Pat. Nos. 5,392,836 and 6,053,237. These devices; however, share some of the same limitations of the other breakaway devices that have already been discussed.

SUMMARY OF THE INVENTION

In order to provide a versatile breakaway device for a sectional door, a release mechanism includes a first member for releasably coupling a track-following guide member to a bracket connected to the door. The first member may be able to snap into and out of the guide member to allow the guide member to move between an operative position where the guide member engages the track and a dislodged position where the guide member separates from the track, or the first member may engage or disengage the guide member in other ways.

In some embodiments, the guide member includes a roller.

In some embodiments, the release mechanism releases easier in one direction than another.

In some embodiments, the release mechanism is selectively reconfigureable to a releasable mode and a non-releasable mode.

In some embodiments, the release mechanism is selectively reconfigureable by selectively inserting a pin in different holes.

In some embodiments, the release mechanism includes a releasable pin that is U-shaped.

In some embodiments, the release mechanism is capable of being reset to its operative position without the use of tools.

In some embodiments, the first member and the guide member completely separate from each other upon moving from the operative position to the dislodged position.

In some embodiments, the guide member is pivotal about the retaining member.

BRIEF DESCRIPTION OF THE DRAWINGS

FIG. 2 is a cross-sectional view taken along line 2—2 of FIG. 1.

FIG. 3 is a front view of one example of a door panel hinge.

FIG. 4 is an end view of the hinge of FIG. 3.

FIG. 5 is an end view of one embodiment of a release mechanism.

FIG. 6 is a front view of FIG. 5.

DESCRIPTION OF THE PREFERRED EMBODIMENT

Figure 1:
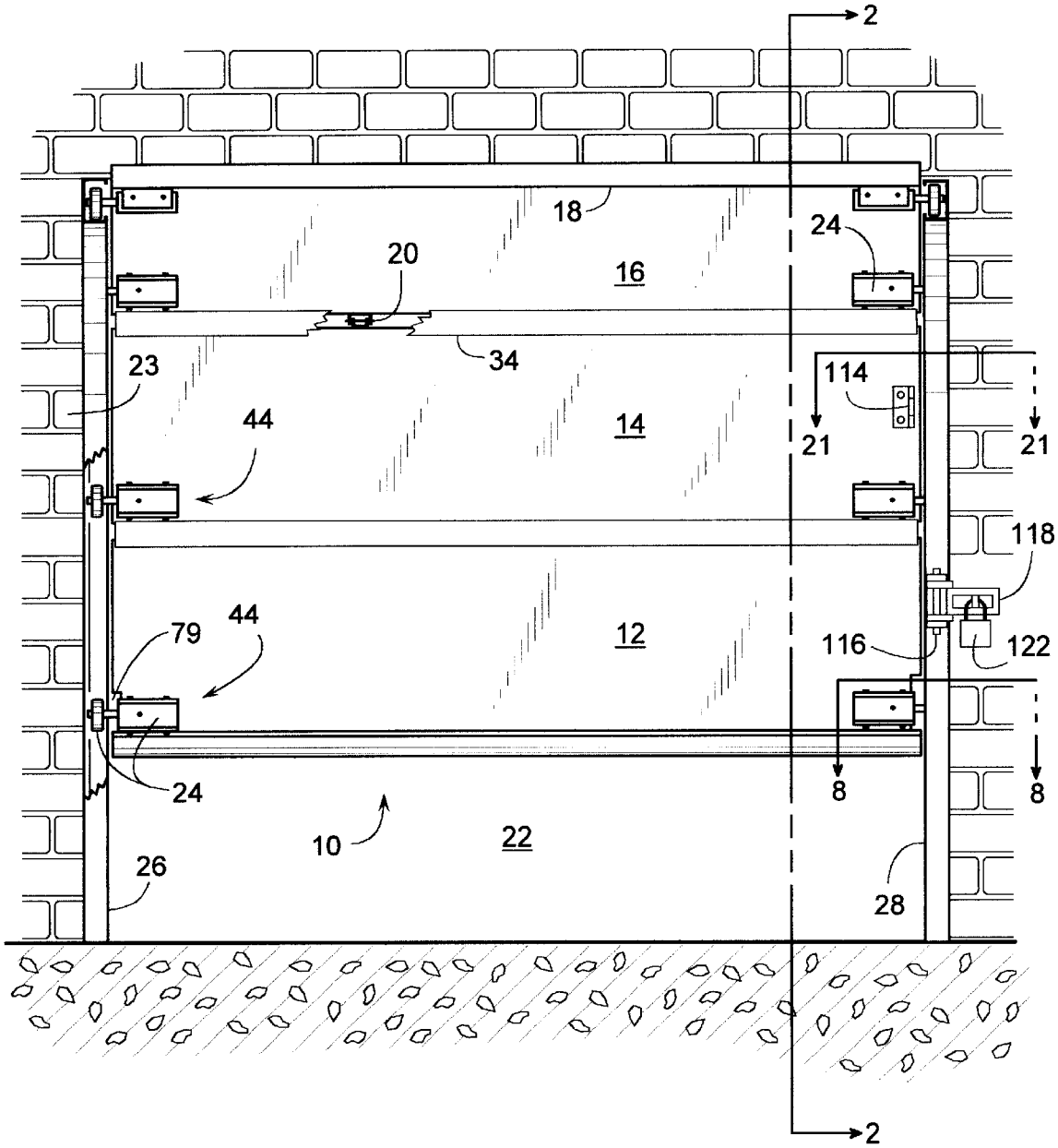
FIG. 1 is a front view of one embodiment of an overhead-storing sectional door in a partially open position, with the door being viewed from inside a building and looking out.

A sectional door 10, shown partially open in FIGS. 1 and 2, includes a series of door panels 12, 14, 16 and 18 that are interconnected along their adjacent horizontal edges by hinges 20. As door 10 opens or closes relative to a doorway 22 defined by a wall 23, guide members 24 guide the movement of the panels along two lateral tracks 26 and 28. In this example, tracks 26 and 28 curve between horizontal and vertical; however, it is well within the scope of the invention to have tracks 26 and 28 run generally linearly or only curve slightly, so that when the door opens, the door panels move above doorway 22 while remaining in a generally vertical or slightly angled orientation. To close door 10, the vertical sections of tracks 26 and 28 guide the panels to a vertical position across doorway 22, as indicated by the positions of panels 12 and 14. When door 10 opens, hinges 20 allow the panels to curve around onto the horizontal sections of tracks 26 and 28, where the door panels store horizontally overhead, as indicated by the position of panel 18.

The actual structure of panels 12, 14, 16 and 18 can vary from one door to another, vary among panels of the same door, or be the same for each panel of the same door and still remain well within the scope of the invention. A door panel according to this embodiment comprises a foam core 30 protected by a tough outer shell 32. Shell 32 may comprise a rectangular metal frame that supports two parallel face panels. The metal frame can also serve as a strong base to which door hardware can be mounted, such as hinges 20 and pliable seals 34. Seals 34 help seal the gap between adjacent door panels. In some cases, hinges 20 comprise a hinge pin 36 that pivotally couples two U-shaped hinge plates 38 and 40, as shown in FIGS. 3 and 4. Hinge plates 38 and 40 can be fastened to the edge of a door panel by way of fasteners 42. It should be noted; however, that the present invention can be applied to doors with other types of hinges; different types of seals (or no seals); and door panels of various other designs, such as those that are solid or hollow.

The primary focus of the invention is to provide a sectional door with a feature that helps protect a door that may be subjected to excessive forces, such as forces that occur during an impact. Such a feature can be provided by a release mechanism 44 that allows one or more door panels (or even just part of one panel) to move away from its guide tracks in response to a sufficient breakaway force being exerted against the door.

In a preferred embodiment, release mechanism 44 includes a U-shaped bracket 46 that attaches adjacent an edge (preferably to the frame) of a panel (e.g., panel 12) by way of a fastener 48, as shown in FIGS. 5 and 6. Between two flanges 50 and 52, bracket 46 supports guide member 24, which in this case, includes a nylon block 54 that supports a shaft 56 of a roller 58 (or some other type of track-guided element, not limited to only those that roll). In some cases, the axial position of shaft 56 can be limited or restrained by some feature such as a conventional cotter pin, C-clip, E-clip, push nut, sleeve 102 (to be explained further with reference to FIG. 15) or in the case of the preferred embodiment, a setscrew 60 that clamps against the side of shaft 56.

Figure 8:
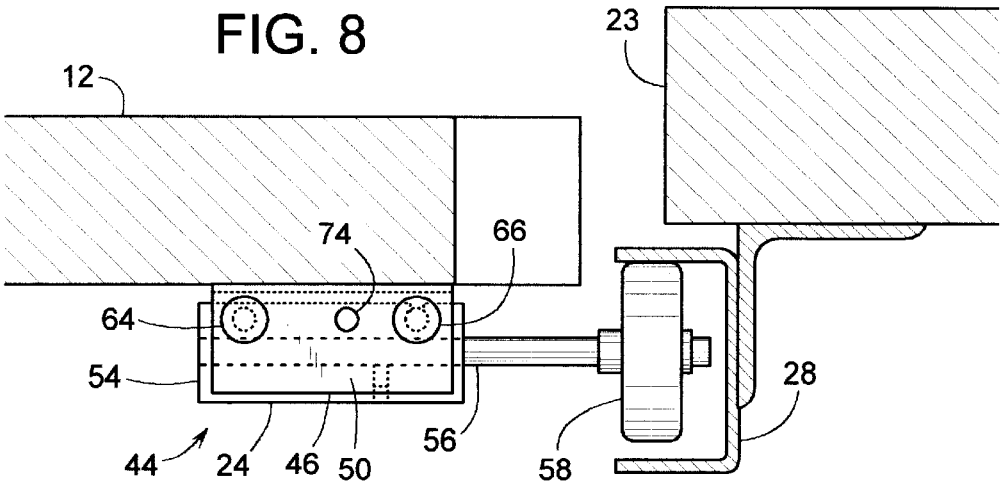
FIG. 8 is a cross-sectional view taken along line 8—8 of FIG. 1, showing a release mechanism is an operative position.
Figure 7:
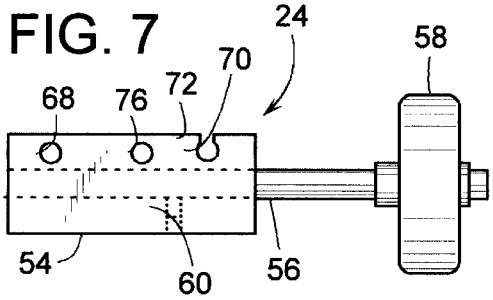
FIG. 7 is a top view of a guide member of the release mechanism shown in FIG. 6.
Figure 9:
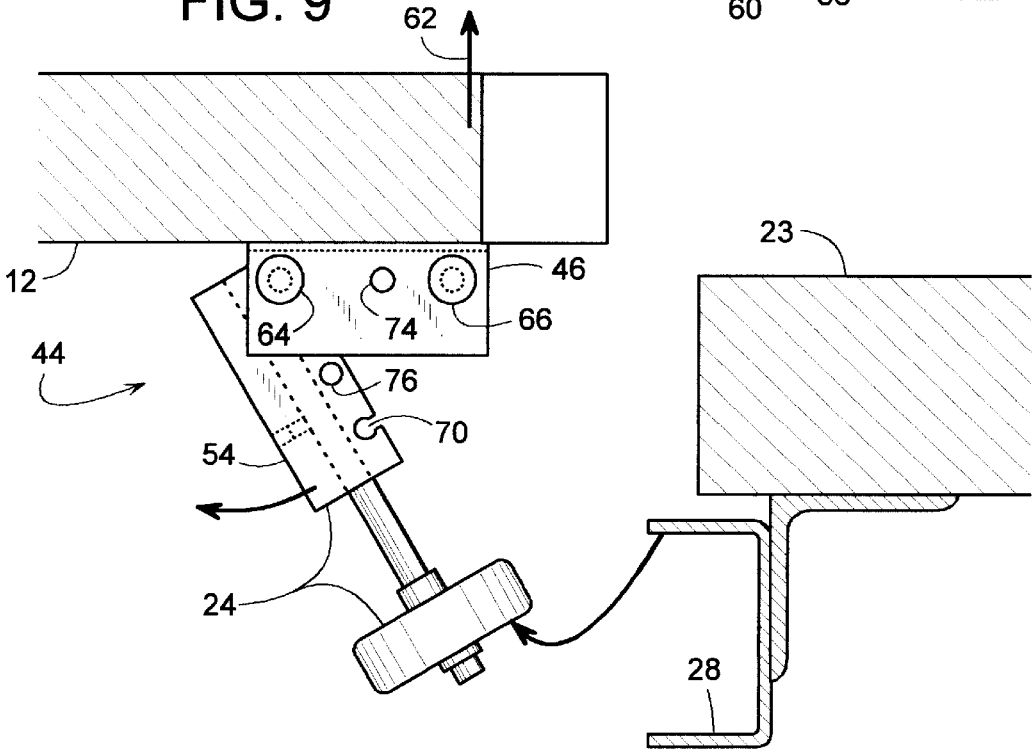
FIG. 9 is similar to FIG. 8, but with the release mechanism in a dislodged position.

To render mechanism 44 releasable under impact (or some other sufficient force applied in the direction indicated by arrow 62 of FIG. 9), block 54 is releasably coupled to bracket 46 in a manner that allows guide member 24 to move from an operative position of FIG. 8 to a dislodged position of FIG. 9. At the same time, block 54 is also coupled to bracket 46 such that the guide member 24 stays attached to the panel even after moving to the dislodged position. Toward that end for release mechanism 44, elongated elements, such as pins 64 and 66 couple block 54 to bracket 46. The term, "pin" refers to any elongated element, examples of which include, but are not limited to, a clevis pin, roll pin, cotter pin, dowel, screw, rivet, nail, threaded rod, etc. Although pins 64 and 66 are used in a preferred embodiment, other elongated elements that do not necessarily resemble a pin are also well within the scope of the invention. Pin 64 extends through two aligned holes in flanges 50 and 52, with a portion 64' (FIG. 6) of pin 64 extending through a hole 68 (FIG. 7) in block 54. In this way, guide member 24 is pivotally mounted to the panel. Alternatively, opposite ends of pin 64 can be welded or otherwise attached to flanges 50 and 52 without the use of holes in the flanges of bracket 46. In a similar manner, pin 66 also extends through two aligned holes in flanges 50 and 52; however, to provide release mechanism 44 with the ability to break away, a portion 66' (FIG. 6) of pin 66 is received within a slot 70 in block 54. In this way, a releasable coupling is created between guide member 24 and panel 12, wherein pin 66 is a first member adapted for selective engagement with the guide member 24 to form a releasable coupling that allows the guide member to move from the engaged to the dislodged position by virtue of complete separation between guide member 24 and pin 66 in response to a force exerted in direction 62, which is generally perpendicular to panel 12. A neck 72 of slot 70 is reduced in width to allow pin 66 to selectively engage (e.g., snap in or out) with block 54, as block 54 swings about pin 64 between the operative and dislodged positions. Pin 64 thus forms a second member that fastens guide member 24 to panel 12 such that guide member 24 stays with panel 12 even after it has moved to the dislodged position.

Disengagement between pin 64 and slot 70 occurs when an impact force applied against and generally perpendicular to panel 12, as indicated by arrow 62, is reacted by a counter force that track 28 exerts against roller 58 in an opposite direction. The counter force being spaced apart from pin 64 produces a clockwise (as viewed in FIG. 9) torque on block 54 about pin 64. The torque forces block 54 to rotate about pin 64 and away from pin 66 (thus separating therefrom) when the force applied along direction 62 is sufficient release pin 66 from slot 70.

To return release mechanism 44 from its dislodged position to its operative position, panel 12 is moved back to its normal operating position adjacent track 28, roller 58 is reinserted into track 28, and pin 66 and block 54 are reconnected. To reconnect pin 66 and 54, the two can be snapped back together or pin 66 can be lifted or lowered lengthwise back into slot 70 once slot 70 is realigned with the holes that receive pin 66. The terms, "snap" and "snapped" refer to the engagement or disengagement of two elements, wherein at least one of the elements resiliently deforms as the two elements engage or disengage.

Although pins 64 and 66 are preferably non-frangible, in some cases it may be desirable to make pin 64 (and/or pin 66) frangible. Pin 64 when frangible could release block 54 from bracket 46 under a predetermined force that is sufficient to break pin 64 but not be so great as to significantly damage other parts of release mechanism 44. Thus, a frangible pin 64 can serve as a sacrificial piece that is relatively inexpensive and easy to replace after panel 12 is dislodged. To render pin 64 frangible, pin 64 can be made of a relatively weak material or be sized to limit its strength.

Figure 10:
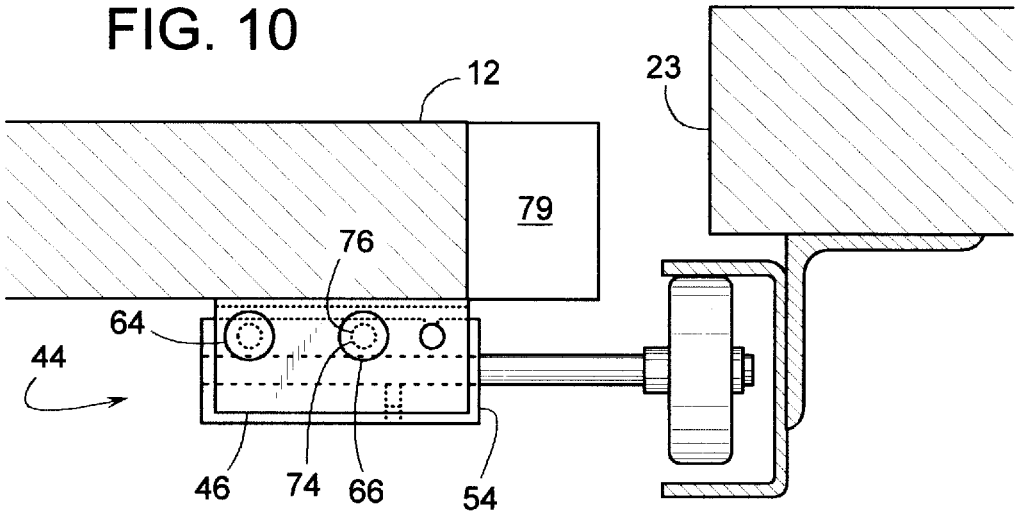
FIG. 10 is similar to FIG. 8, but with the pins of the release mechanism in a different position.

To selectively disable the breakaway feature of release mechanism 44, pin 66 is removed from slot 70 and the corresponding holes of bracket 46, and reinserted through another set of holes 74 and 76 that are in bracket 46 and block 54, respectively, as shown in FIG. 10.

Figure 12:
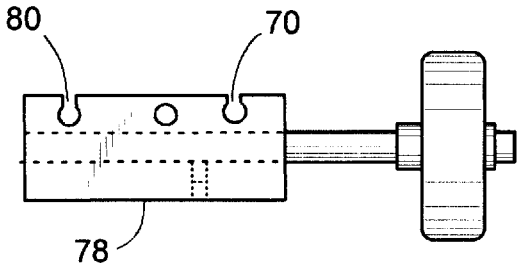
FIG. 12 is a top view of a guide member that provides a release mechanism with bi-directional breakaway.
Figure 11:
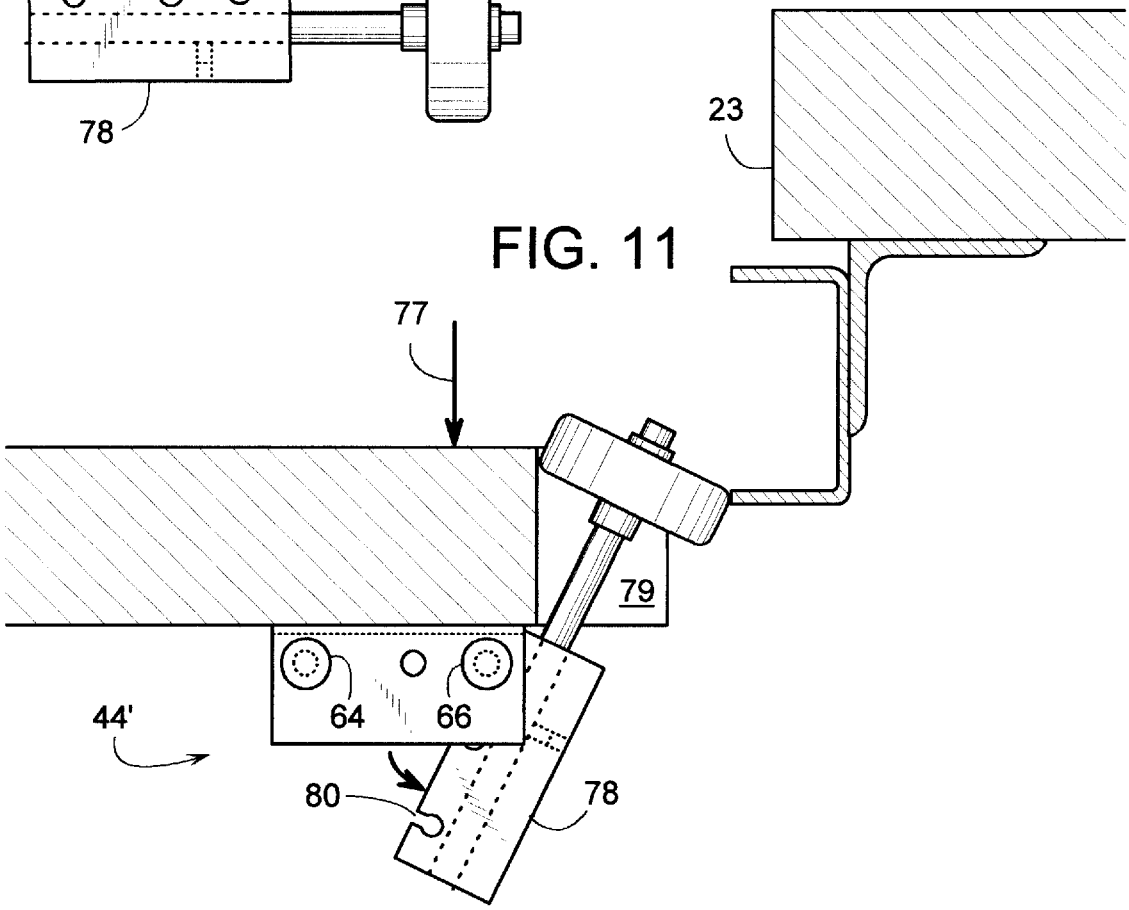
FIG. 11 is similar to FIG. 10, but with the release mechanism in a dislodged position.

To allow a door panel to move in response to an impact from either direction (i.e., from inside to outside, as indicated by arrow 62 of FIG. 9, or from outside to inside, as indicated by an arrow 76 of FIG. 11), a release mechanism 44' can be provided with a modified block 78, as shown in FIG. 12. Block 78 is similar to block 54; however, a slot 80 in block 78 replaces hole 68 of block 54. Slots 70 and 80 are similar in that they both allow their respective pins 66 and 64 to selectively and engage and release block 78. Sufficient force acting against a door panel in the direction of arrow 77 can force block 78 to swing about pin 66 and break away from pin 64, or sufficient force acting in an opposite direction (direction 62 of FIG. 9) can force block 78 to swing about pin 64 and break away from pin 66. Thus, release mechanism 44' has two pivot points: pin 64 and 66. Moreover, pin 64 in this embodiment forms a second member that is adapted for selective engagement with the guide member. Thus, both pins 64 and 66 are capable of pivotally mounting guide member 24 to panel 12 when breakaway or release occurs about the other pin, while at the same time being capable of themselves selectively disengaging from guide member 24 for an appropriately directed breakaway force. To provide one or more guide member 24 with sufficient clearance to swing to the position of FIG. 11, door panel 12 and/or the other door panels are provided with a notched out section 79.

In some cases, pin 64 and slot 80, and pin 66 and slot 70 may be sized differently to provide release mechanism 44' with a breakaway threshold that is greater in one direction than the other. In other cases, the dimensions of pins 64 and 66 and their fit within their respective slots 80 and 70 may be identical and still provide a threshold differential or breakaway threshold that is greater in direction 77 than in direction 62 by virtue of track 28 being closer to pin 66 than to pin 64, which provides a leverage advantage to a force acting in direction 62 (opposite to direction 77). To provide an equal breakaway threshold in both directions, the engagement between pin 64 in slot 80 may be made loser than the engagement between pin 66 and slot 70 to compensate for the threshold differential brought on by pins 64 and 66 being at an unequal distance away from track 28.

Figure 13:
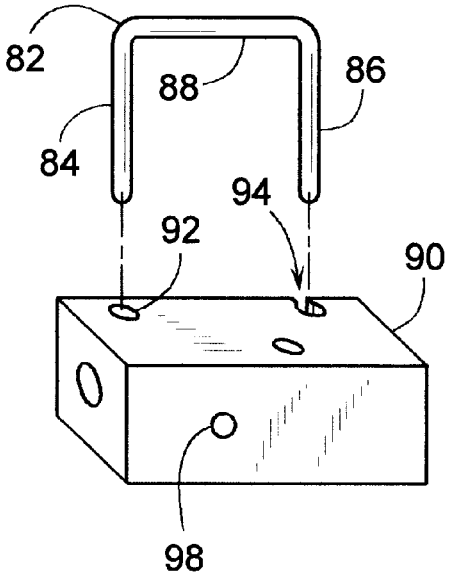
FIG. 13 is a perspective view of a retainer being inserted into a block of a guide member to provide unidirectional breakaway.
Figure 14:
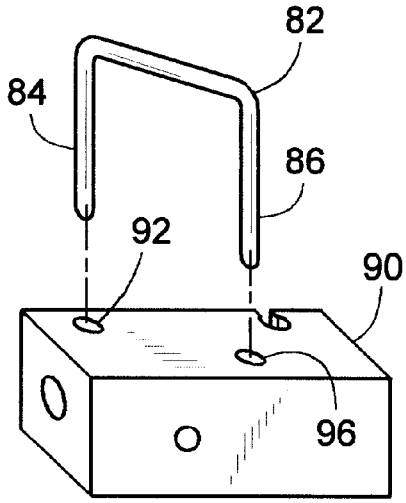
FIG. 14 is similar to FIG. 13, but with the retainer being inserted into the block so as to disable the breakaway feature.
Figure 15:
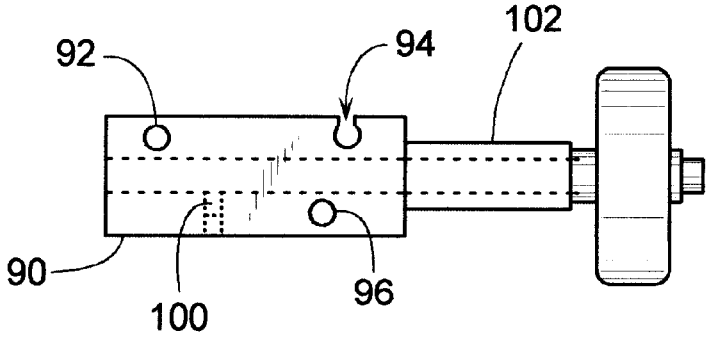
FIG. 15 is a top view of the block of FIGS. 13 and 14 with a roller inserted in the block.

Although pins 64 and 66 have been described as individual pins, the two pins can be joined or formed as a unitary U-shaped retainer 82, as shown in FIGS. 13–15. Retainer 82 comprises a pin 84 and a pin 86 that are connected by a cross member 88. Retainer 82 can be used in conjunction with a block 90 that is similar to blocks 54 and 78. The distance between a hole 92 and a slot 94 is preferably the same as the distance between a hole 96 and hole 92, with the layout of slot 94 and holes 92 and 96 corresponding to a matching pattern of three holes in a bracket similar to that of bracket 46. Inserting retainer 82 in the position of FIG. 13 (i.e., pin 84 in hole 92, and pin 86 in slot 94) provides a release mechanism that operates like release mechanism 44 of FIG. 9. And inserting retainer 82 in the position of FIG. 14 (i.e., pin 84 in hole 92, and pin 86 in hole 96) disables the breakaway feature to provide an operating mode similar to release mechanism 44 of FIG. 10. A hole 98 for a setscrew 100 is positioned so as not to interfere with hole 96. Sleeve 102, as shown in FIG. 15, extends over the shaft of the guide roller to reinforce the shaft and help establish a certain spacing between the roller and block 90.

Figure 16:
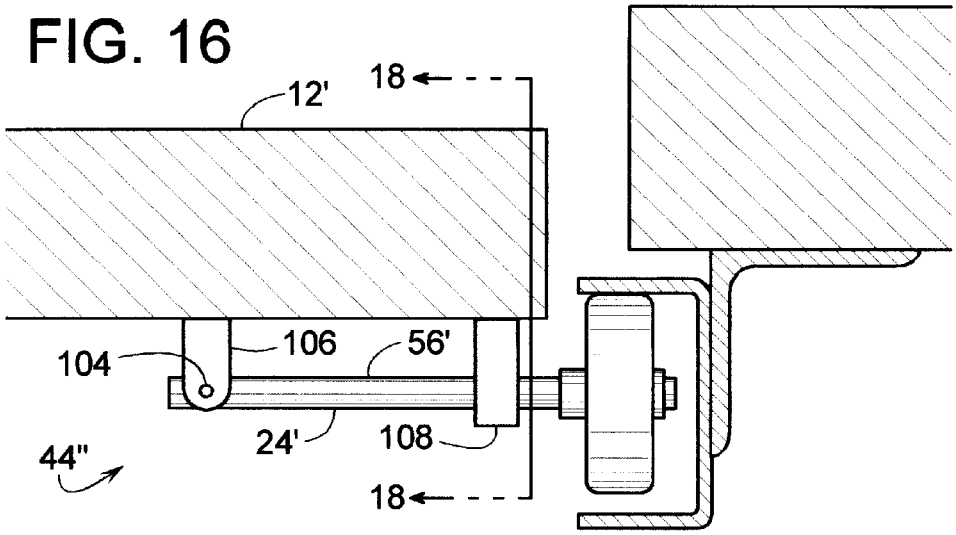
FIG. 16 is similar to FIG. 8, but of another release mechanism in an operative position.
Figure 17:
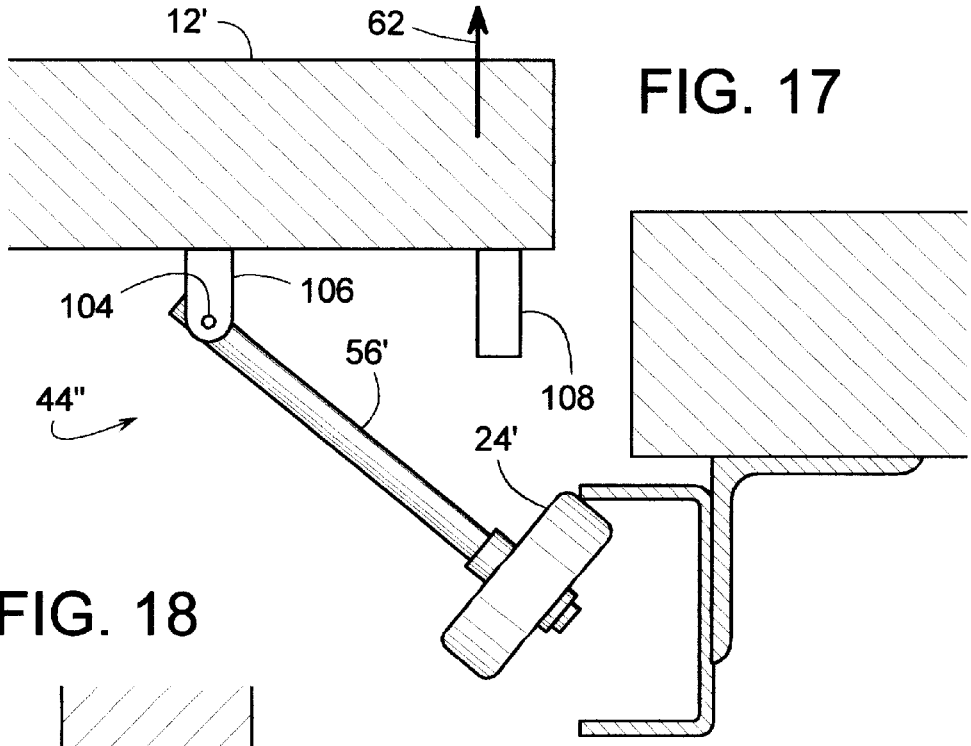
FIG. 17 is the release mechanism of FIG. 16, but with the release mechanism in a dislodged position.
Figure 18:
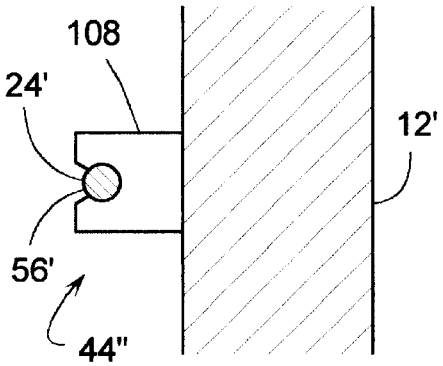
FIG. 18 is a cross-sectional view taken along line 18—18 of FIG. 16.

As a further illustration of the inventive release mechanism, an alternative embodiment including release mechanism 44" is provided, as shown in FIGS. 16–18. Release mechanism 44" includes a guide member 24' whose shaft 56' is pivotally coupled to a door panel 12' by way of a pin 104 that that can be connected to panel 12' directly or connected indirectly through a bracket 106. With sufficient force acting in direction 62, guide member 24' pivots about pin 104 to disengage or separate from a releasable bracket 108, which is attached to panel 12' at a position between pivot pin 104 and the portion of guide member 24' engaged with the track. In some embodiments, releasable bracket 108 is a snap-action device; however, bracket 108 is schematically illustrated to encompass any device that is adapted for selective engagement (FIGS. 16 and 18) and disengagement (FIG. 17) with guide member 24'. Releasable bracket 108 thus forms a first member adapted for selective engagement with the guide member 24' in a similar sense to the way that pin 66 of the embodiment of FIG. 9 is adapted for selective engagement with guide member 24. That is, the concept of adapted for selective engagement can encompass the situation where the guide member is yieldable relative to a generally rigid first member (as in slot 70 yielding relative to the generally rigid pin 66 in FIG. 9) and the situation where the guide member is generally rigid, and it is the first member that yields relative to the guide member (as in releasable bracket 108 yielding relative to generally rigid shaft 56' of guide member 24' in FIGS. 16–18). In all of the embodiments described so far, then, the guide member is pivotally mounted to the panel, and a first member is provided that is adapted for selective engagement with the guide member to selectively place the guide member in an operative position and a dislodged position, with the first member and guide member being separated in the dislodged position.

Figure 19:
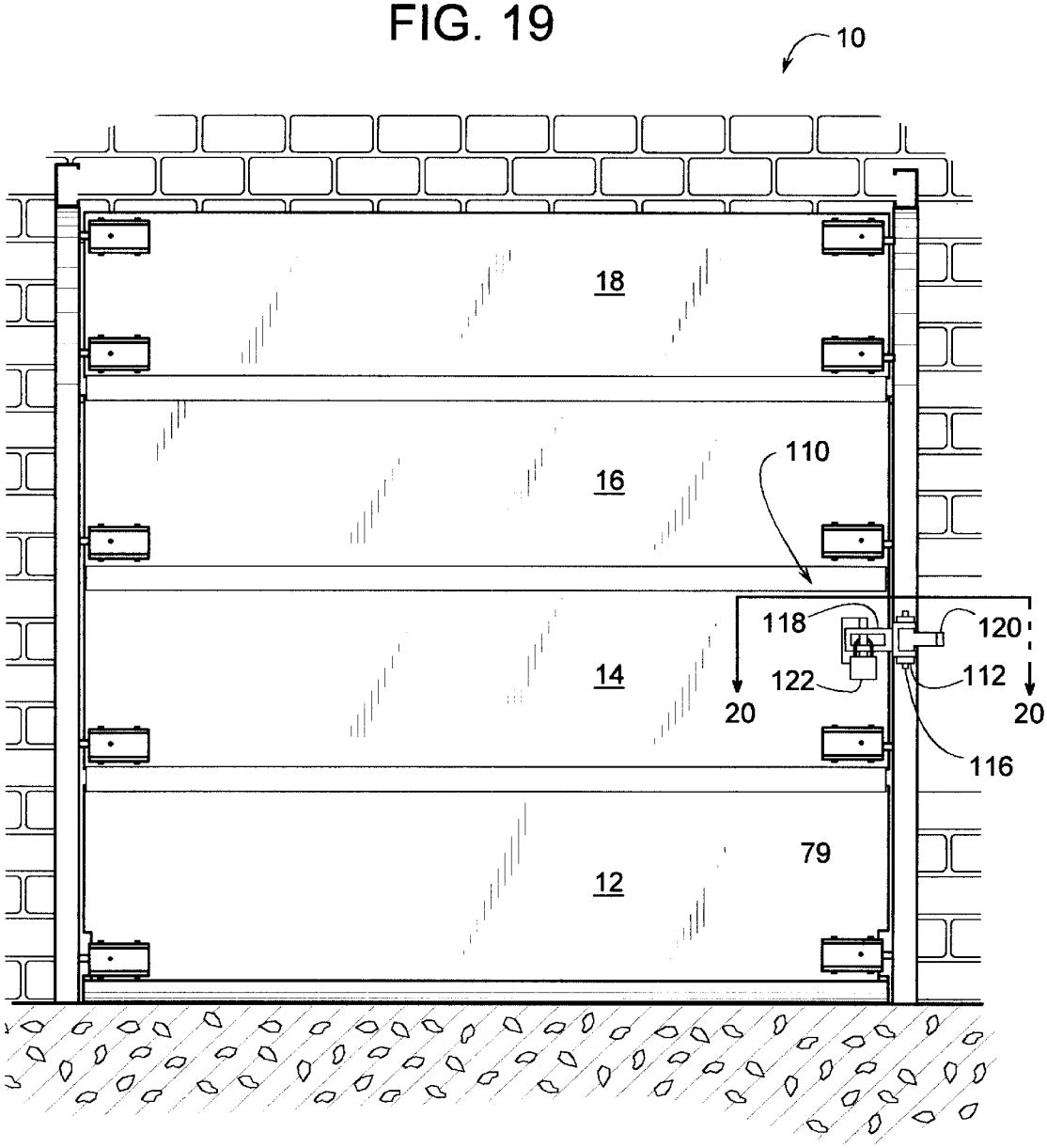
FIG. 19 is similar to FIG. 1, but with the door closed.
Figure 20:
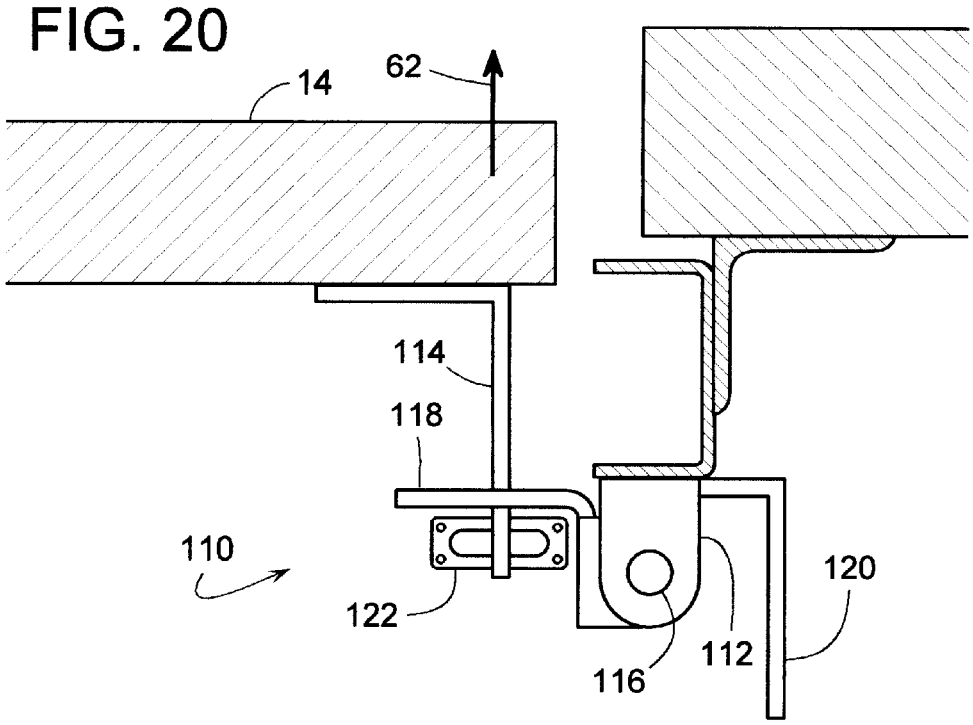
FIG. 20 is a cross-sectional view taken along line 20—20 of FIG. 19 (with some features pertaining to the rollers and release mechanism omitted for clarity).

To allow door 10 to be held in a closed position without limiting the breakaway ability of a release mechanism, door 10 is provided with a latch mechanism 110, as shown in FIGS. 1, 2 and 19–21. Latch mechanism 110 includes a base 112 whose position is stationary and a traveling bar 114, which is attached to panel 14. A pin 116 rotatably couples an arm 118 to base 112, so arm 118 that can swing over and thus capture traveling bar 114 to inhibit door 10 from opening, as shown in FIGS. 19 and 20. Even though arm 118 engaging bar 114 inhibits panel 14 from rising, door panel 14 can still be forcibly dislodged in direction 62, because panel 14 (as it becomes dislodged) can move bar 114 from the restraint of arm 118 by moving arm 144 in direction 62.

Figure 21:
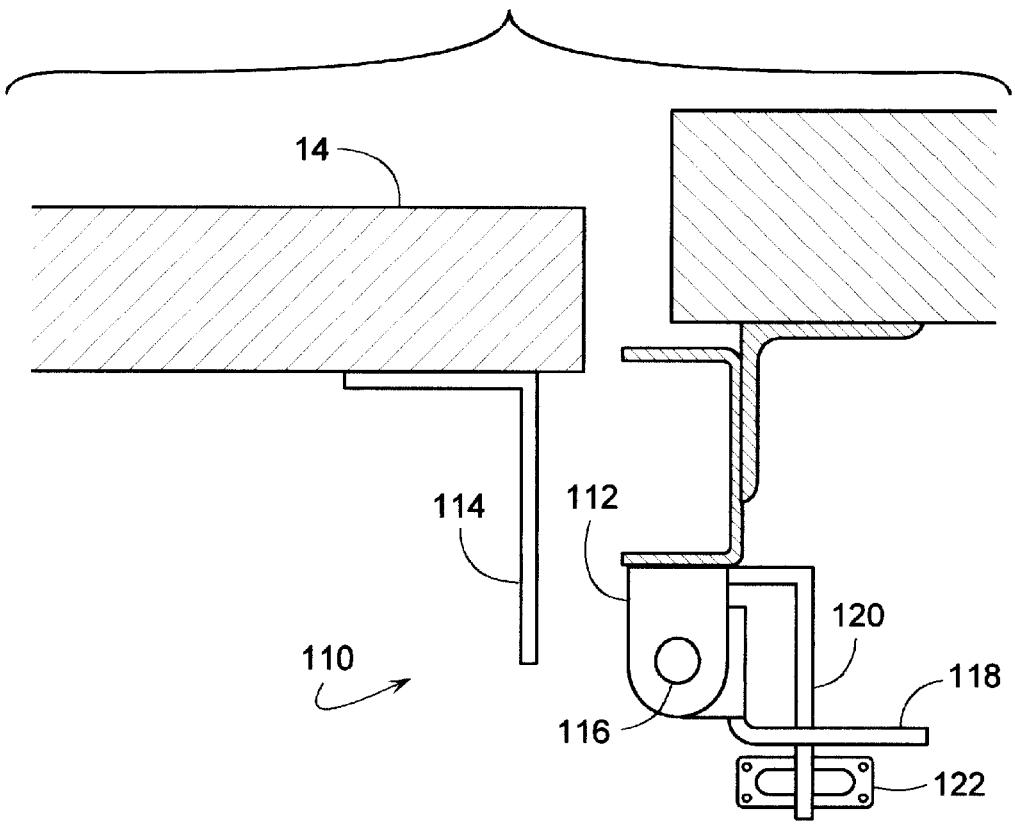
FIG. 21 is a cross-sectional view taken along line 21—21 of FIG. 1 (with some features pertaining to the rollers and release mechanism omitted for clarity).

To release door 10 under normal, non-breakaway conditions, arm 118 can swing away from bar 114 and preferably swing over and onto a stationary bar 120 that extends from base 112, as shown in FIGS. 1, 2 and 21. To inhibit arm 118 from accidentally swinging off bars 114 or 120, a distal end of each bar 114 and 120 can be provided with a hole to receive the shackle of a padlock 122, whereby padlock 122 can hold arm 118 at either selected location: on bar 114 or 120.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A release mechanism for a door panel of a door whose movement is guided by a track, the release mechanism comprising:

a bracket attachable to the door panel;

a guide member being adapted to travel along the track as the door opens and closes; and a first member disposed on the bracket and adapted for selective engagement with the guide member to selectively place the guide member in an operative position and a dislodged position, wherein the guide member in the operative position is adapted to engage the track, and the guide member in the dislodged position is adapted to disengage the track, wherein the first member is frangible to release the guide member upon the first member breaking at a predetermined level.

2. A release mechanism for a door panel of a door whose movement is guided by a track, the release mechanism comprising:

a bracket attachable to the door panel;

a guide member being adapted to travel along the track as the door opens and closes; and a first member disposed on the bracket and adapted for selective engagement with the guide member to selectively place the guide member in an operative position and a dislodged position, wherein the guide member in the operative position is adapted to engage the track, and the guide member in the dislodged position is adapted to disengage the track, wherein a first portion of the first member is able to selectively snap into and out of engagement with the guide member by virtue of a slot in the guide member.

3. The release mechanism of claim 2, wherein the slot runs substantially parallel to the first portion of the first member.

4. A release mechanism for a door panel of a door whose movement is guided by a track, the release mechanism comprising:

a bracket attachable to the door panel;

a guide member being adapted to travel along the track as the door opens and closes;

a first member disposed on the bracket and adapted for selective engagement with the guide member to selectively place the guide member in an operative position and a dislodged position, wherein the guide member in the operative position is adapted to engage the track, and the guide member in the dislodged position is adapted to disengage the track; and a second member selectively insertable through a hole in the bracket to engage the guide member, such that the second member being inserted in the hole maintains the guide member in the operative position.

5. The release mechanism of claim 4, wherein the first member and the second member are integrally joined to each other to comprise a unitary U-shaped piece.

6. A release mechanism for a door panel of a door whose movement is guided by a track, the release mechanism comprising:

a guide member being pivotally mounted to the door panel and being adapted to travel along the track as the door opens and closes; and a first member disposed on the panel and adapted for selective engagement with the guide member to selectively place the guide member in an operative position and a dislodged position, wherein the guide member in the operative position is adapted to engage the track, and the guide member in the dislodged position is adapted to disengage the track, wherein the first member is able to selectively snap into and out of engagement with the guide member by virtue of a slot in the guide member.

7. A release mechanism for a door panel of a door whose movement is guided by a track, the release mechanism comprising:

a guide member being pivotally mounted to the door panel and being adapted to travel along the track as the door opens and closes;

a first member disposed on the panel and adapted for selective engagement with the guide member to selectively place the guide member in an operative position and a dislodged position, wherein the guide member in the operative position is adapted to engage the track, and the guide member in the dislodged position is adapted to disengage the track; and a second member disposed on the panel and being adapted for selective engagement with the guide member, wherein the first member and the second member are integrally joined to each other to comprise a unitary U-shaped piece.

8. A release mechanism for a door panel of a door whose movement is guided by a track, the release mechanism comprising:

a bracket attachable to the door panel;

a guide member being adapted to travel along the track as the door opens and closes; and a retainer selectively movable to a first position and a second position, wherein the guide member is able to returnably break away from the bracket when the retainer is in the first position, however the retainer in the second position prevents the guide member from returnably breaking away, wherein the pin in the second position extends along a slot in the guide member.

* * * * *